United States Patent [19]

Cook, Jr.

[11] 4,141,584

[45] Feb. 27, 1979

[54] SUPPORTIVE FURNITURE SYSTEM, SUCH AS A CHAIR SYSTEM, AND METHOD OF MANUFACTURE

[76] Inventor: Victor J. Cook, Jr., 613 Dumaine St., New Orleans, La. 70116

[21] Appl. No.: 751,539

[22] Filed: Dec. 16, 1976

[51] Int. Cl.[2] ..... A47C 7/00

[52] U.S. Cl. ..... 297/41; 297/35; 297/440

[58] Field of Search ..... 297/16, 35–41, 297/59, 60, 420, 440, 441, 445–447

[56] References Cited

U.S. PATENT DOCUMENTS

| | | | |
|---|---|---|---|
| 1,955,490 | 4/1934 | Emerson | 297/39 |
| 2,136,838 | 11/1938 | Bosschieter | 297/41 X |
| 2,783,825 | 3/1957 | Gittings et al. | 297/39 |

FOREIGN PATENT DOCUMENTS

| | | | |
|---|---|---|---|
| 13478 | 8/1934 | Australia | 297/35 |

*Primary Examiner*—James C. Mitchell

*Attorney, Agent, or Firm*—C. Emmett Pugh

[57] ABSTRACT

An arm chair and its method of manufacture provides a plurality of standardized, build-up, structural components, the components being joined by means of pin joinings at the appropriate joints, the individual structural components predrilled to accommodate standardized fasteners of substantially identical diameter. The chair is constructed in a method which provides a balanced seating geometry to equally distribute stresses applied to the chair. Structural components are of substantially identical cross-sectional dimensions and of substantially identical material. The chair can be folded into a compact, space saving position.

5 Claims, 5 Drawing Figures

SUPPORTIVE FURNITURE SYSTEM, SUCH AS A CHAIR SYSTEM, AND METHOD OF MANUFACTURE

REFERENCE TO RELATED APPLICATION

This application is directed to the utility aspects of the chair design disclosed in the copending design Patent Application, Ser. No. 665,730, filed Mar. 10, 1976.

BACKGROUND OF THE INVENTION

1. Field of the Invention

The present invention relates to furniture and methods of furniture construction. More particularly, the present invention relates to a method of furniture manufacturing and an article of furniture, the method utilizing standardized unitized structural components, standardized fasteners and a geometrically balance assembly plan.

2. General Background and Prior Art

The construction of furniture and the like requires generally that materials be cut and/or formed to meet specifications prior to their assembly into a finished article of manufacture. Generally, the structural integrity of a given piece of furniture is insured by varying the configuration of individual structural components which form the final product. The cross-sectional dimensions of some members which receive greatest stress in use are generally larger than the dimensions of structural components which receive lesser stress. Additionally, variation in structural component configuration are necessary to give an aesthetically pleasing appearance to the final product to thereby enhance its saleability. Thus, when a particular article of furniture is manufactured, it is generally necessary to sacrifice efficiency and economy in order to achieve both an attractive and structurally worthy product. This sacrifice while producing perhaps a saleable item, usually results in an increase in price to the consuming public.

Patents have been issued for furniture construction methods and more specifically for the construction of chairs. Examples of two prior art devices which have been patented are provided by U.S. Pat. No. 1,813,020 issued to N. N. Brown on July 7, 1931 and U.S. Pat. No. 3,873,154 issued to R. E. Baker, Jr. on Mar. 25, 1975.

The present invention utilizes the uniform structural components in a balanced geometric assembly configuration which distributes stresses properly to all the members, thereby allowing individual components to be of a standard uniform and smaller size. The joints between members is a face-to-face pinned connection which allows the chair to be totally prefabricated before its final assembly which could be, for example, performed by the consumer himself. Since the individual structural components have a constant square cross-section, they can be drilled in manufacture without regard to orientation as to length or width. Likewise, once the individual component is predrilled for assembly, the final assembly requires a minimum amount of orientation of the member itself before assembly by the consumer.

Thus, the present invention lends itself to a total kit type operation whereby the manufacturer only provides individual structural components of a single uniform cross-section throughout their length, predrilled with necessary uniform diameter connection holes and a plurality of constant diameter binding fasteners to make a complete kit for assembling a chair. Other than these easily manufactured and economical components, only the balanced frame geometry and a set of assembly instructions is required.

GENERAL DISCUSSION OF THE PRESENT INVENTION

The present invention provides an attractive, comfortable, heavy load bearing, and efficient article of furniture utilizing a minimum volume/mass of standard materials and processing.

The present invention provides individual structural components which are standardized to a substantially identically cross sectional dimension with varying lengths for individual furniture articles. Each furniture article is constructed utilizing a balanced geometric assembly plan which properly distributes the load to the various structural components of the furniture article. The individual structural components are pin joined using standardized fasteners which are attached through the pin joints at pre-drilled holes which are sized so as to properly accomodate the standard fasteners. Each pinned joint where a given plurality of structural components is connected is oriented in such a manner as to form a rigid and structurally sound connection.

The joint connections are rigid structurally, but some joints additionally can pivot upon the removal of certain fasteners, allowing the furniture article to fold.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
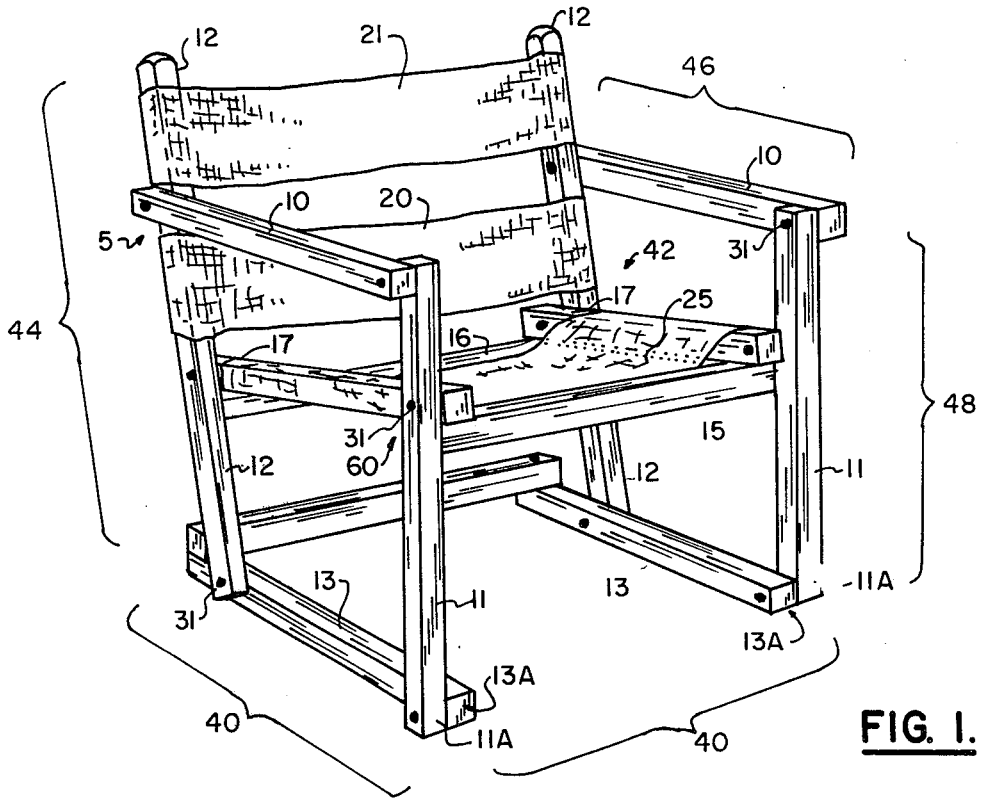
FIG. 1 is a perspective, front view of the preferred embodiment of the furniture article of the present invention.

FIG. 1 illustrates the preferred embodiment of the article of furniture of the present invention comprised generally of a plurality of structural component members 10–17 which are connected at their end portions (as can best be seen in FIG. 1) by a plurality of fasteners 31. The preferred embodiment illustrated in FIG. 1 is a chair designated generally by the numeral 5. The seat portion of the chair designated by the numeral 25 can be of a strong but flexible type material such as canvas, leather, vinyl or the like. The back portion of the chair provides support by means of two, like flexible supports 20, 21.

Structural supports 10–17 are of a substantially identical cross-sectional dimension. In the preferred embodiment, structural supports 10–17 are provided with square cross-sections which can be for example, 1½" by 1½". A rectangular cross-section would also be suitable, as preferably a cross-section providing squared sides and right angular corners if desired. The cross-sectional dimension would be preferably uniform throughout the length of an individual structural support 10–17 which would then provide an easily manufactured and economical component 10–17. With this uniformity, a large number of structural components 10–17 could be premanufactured and later cut and pre-drilled with connection openings where necessary.

In the preferred embodiment, component members 10–17 can be of any rigid, structural yet economical material, such as for example, wood.

Figure 4:
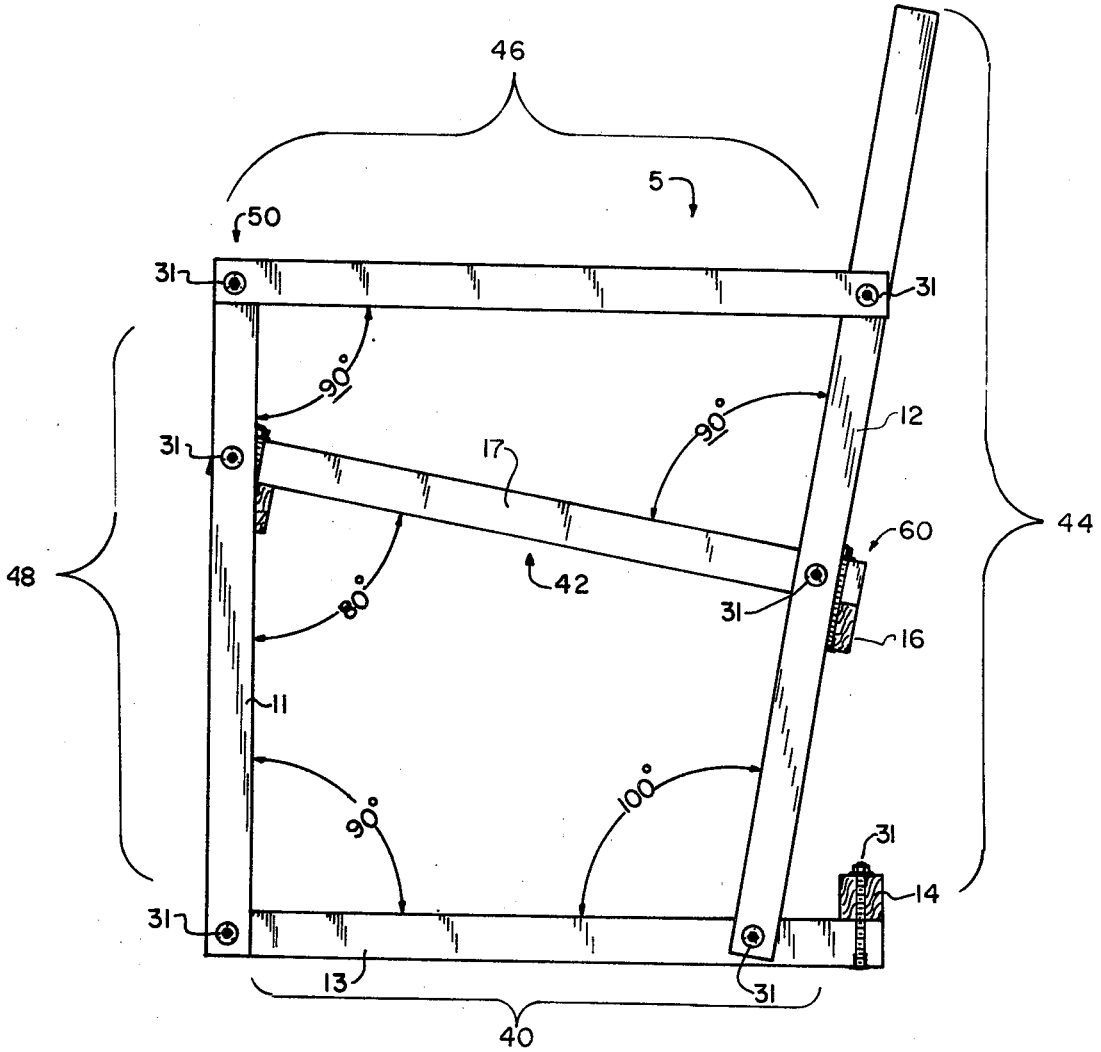
FIG. 4 is a side view of the preferred embodiment of the article of furniture of the present invention illustrating an exemplary geometric assembly plan and having certain limited areas cut away to show the position of some of the fasteners.

Since the structural component members 10–17 of the chair 5 will be utilized in different portions of the chair which will necessarily sustain differing stresses during use, the present invention provides that the chair be assembled using a balanced and supportive frame geometry. FIG. 4 illustrates an inventive example of such a workable frame geometry for the chair 5 which will assure a structurally sound and rigid piece of furniture that can withstand the stresses applied during use by the consumer. This feature is important since all the component members of the chair are manufactured of a substantially identical cross-sectional dimension, with members experiencing greatest stress being afford no greater structural integrity than other members of the chair. FIG. 4 represents a side view of chair 5 and illustrates the preferred geometric relationships between the support components 10–17. Although the particular angles shown have been found to be suitable and are preferred, a little variation of a few degrees is possible in the non-orthogonal joints, but the angles should at least be of the order of the angles illustrated (namely of the order of 100° and 80°.

Figure 2:
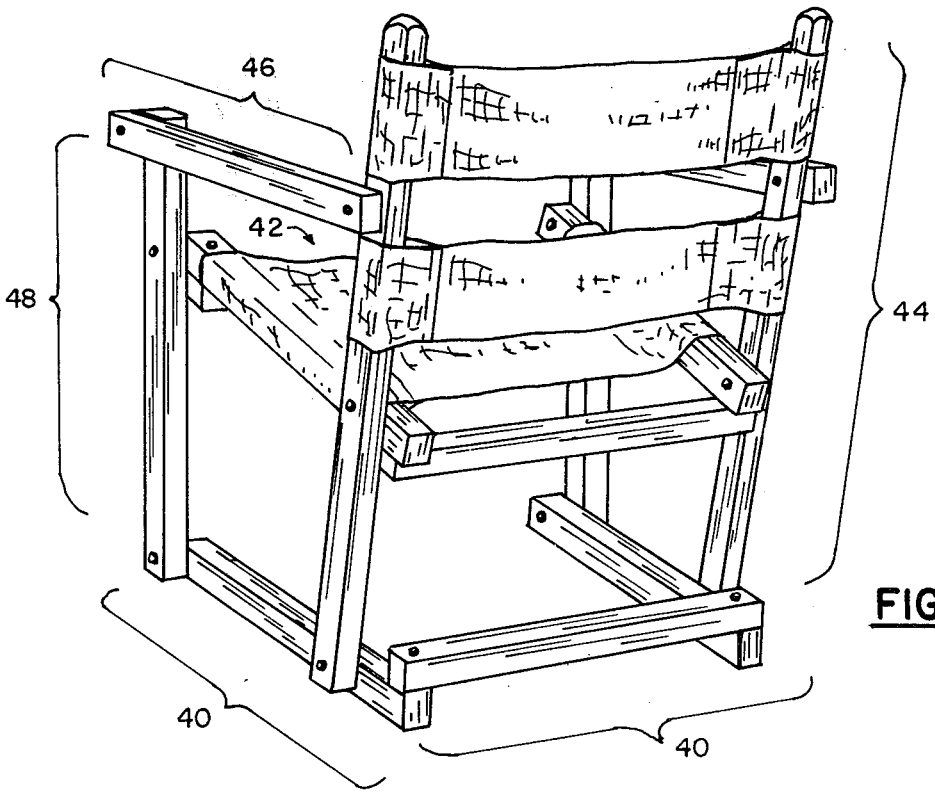
FIG. 2 is a perspective, rear view of the preferred embodiment of the furniture article of the present invention.
Figure 3:
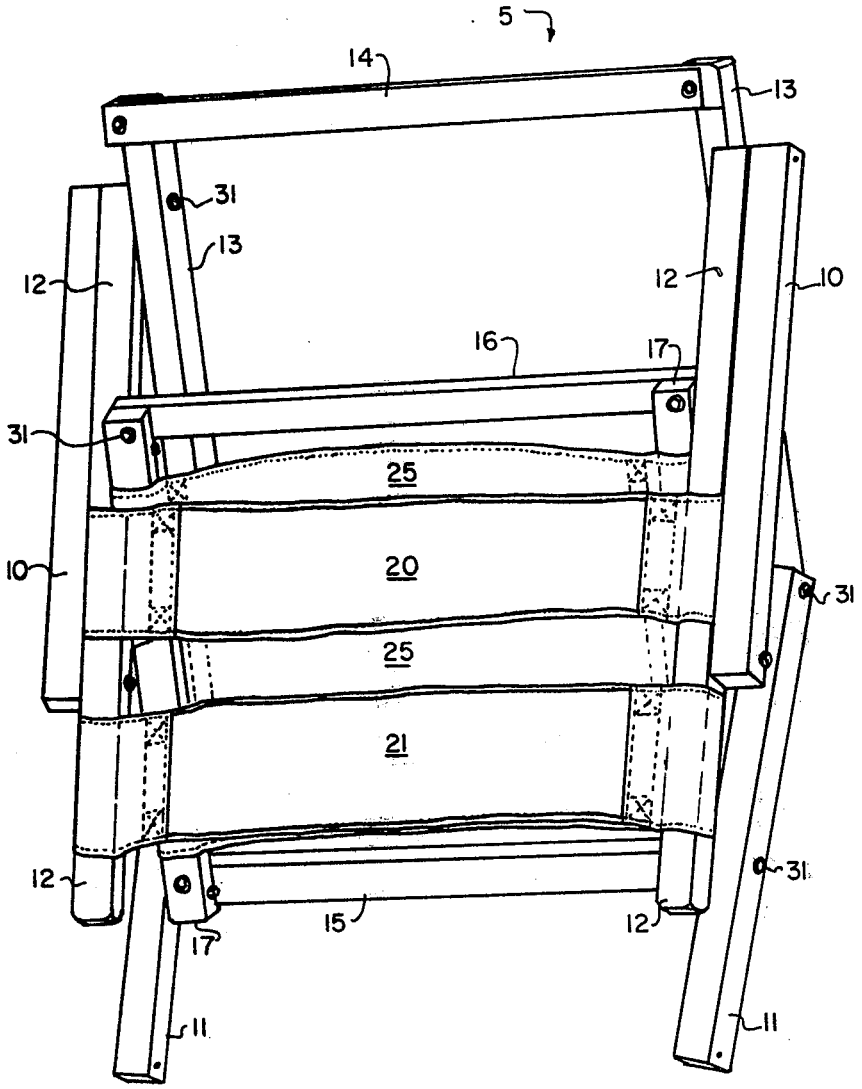
FIG. 3 is a perspective view of the article of furniture of FIG. 1 in a folded position.

As can best be seen in FIGS. 1 and 2, there is provided for chair 5 a base, a seat, a back portion, an arm rest portion and a front represented generally by the numerals 40, 42, 44, 46 and 48 respectively, in FIG. 2. Base 40, which can contact the floor or other support surface along its full length, forms an angle of 90° with front portion 48. An angle of 100°, for example, is formed between base 40 and back portion 44. Back portion 44 forms an angle of 90° with seat 42 and an exemplary angle of 100° with arm rest portion 46. Seat 42 additionally forms an exemplary angle of 80° with front portion 48. The side portions formed by elements 10, 11, 12 and 13 are parallel and form an angle of 90° with respect to the base section 40.

It can be seen by one skilled in the art by an inspection of FIG. 4 that the geometric configuration provided to the structural components 10–17 produces a rigid structure. However, the chair 5 can be folded by the removal of the pins 31 at the joints between upper arms 10 and front legs 11, the joints being designated by the numeral 50 in FIG. 4 illustrates the folded position of chair 5 after the removal of fasteners 31 from joint 50 on each side of the chair 5 respectively. A further collapsible feature of chair 5 can be utilized for storage by the removal of three cross-braces 14, 15 and 16. With the removal of these braces, the chair will then comprise two rigid sections connected together by the flexible seat portion 25 and back portions 20, 21 which can be collapsed and rolled together into a tight compact disposition for storage.

The exemplary frame geometry for chair 5 provides a proper distribution of forces allowing the chair 5 to be constructed with highly standardized construction parts while still maintaining the structural integrity of the chair itself. Thus, it can be seen that chair 5 could be manufactured with a minimum amount of labor and materials while still providing a structural sound and aesthetically pleasing unit for consumer use at a considerable savings in cost.

Fasteners 31, which can be for example nut and bolt type fasteners, are provided to make rigid pinned connections at the joints between the various component supports 10–17. FIG. 1 more particularly illustrates the construction of chair 5. Base portion 40 is provided with a pair of bottom braces 13 connected at the upper surfaces of their rear portions by lower cross-bar 14. Front legs 11 are connected to base 40 by means of fasteners 31 at the front tip portions 13A of bottom braces 13 and at the lower tip portion 11A of legs 11. It can be seen that the tip portions 13A of bottom braces 13 substantially align flush with the lower front bases 11A of legs 11. This results, because openings are provided in the end portions of all structural supports 10–17 which are substantially symmetrically placed about the cross-sectional axis of each support member 10–17.

Thus, as can be seen in FIG. 1, all the jointed connections which result in 90° angular connections will provide an aesthetically pleasing, smooth, face-to-face orthogonal joint. Note that the same connection formed by bottom braces 13 and legs 11 is achieved at the joints 50 of legs 11 and arms 10.

A like face-to-face, orthogonal connection is provided by the connection at the lower, rear cross-bar 14 and bottom braces 13. A like connection is formed at the joints of front, upper cross-bar 15 and seat stretcher members 17, as well as at the joints between seat stretcher members 17 and rear, upper cross-brace 16. In the former connection, it is highly desirable that the front cross-bar 15 is connected to the underside of the members 17 and inboard of the angled connection between the front legs 11 and the members 17.

Figure 5:
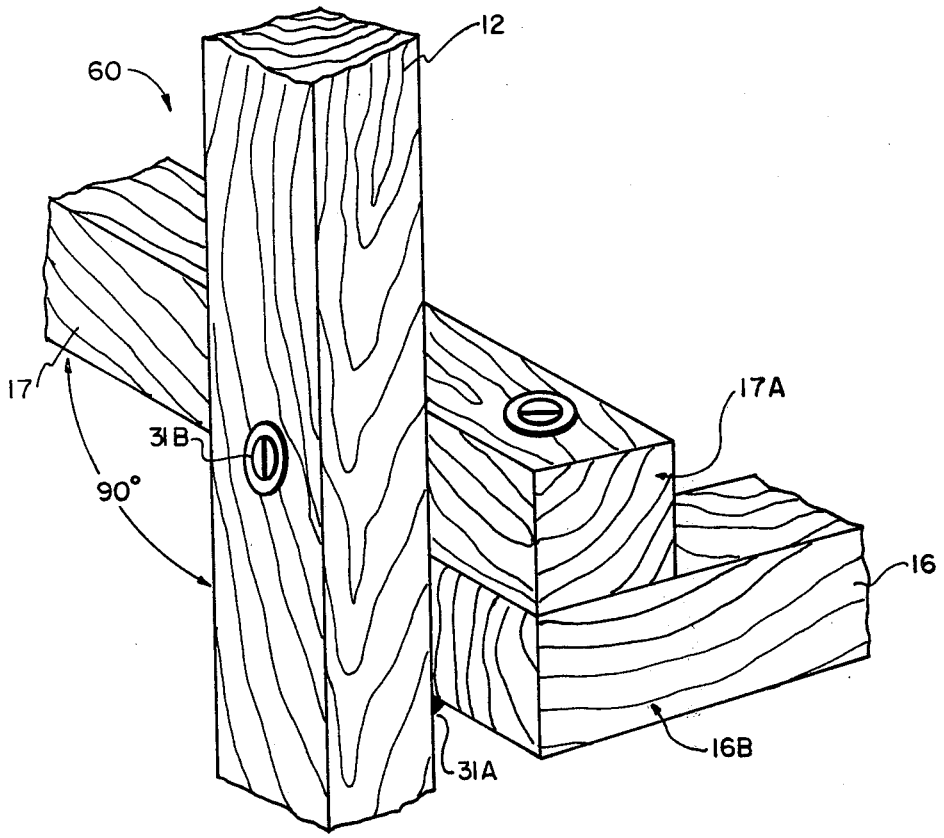
FIG. 5 is a partial, perspective view of the preferred embodiment of the article of furniture of the present invention illustrating a special pinned joint used in the present invention.

FIG. 5 illustrates a three piece, partially orthogonal joint designated generally by the numeral 60, the joint represented in FIG. 5 illustrating the three-way joint 60 which is formed at the rear joints of seat structure member 17, rear, upper cross-bar 16 and rear leg 12. As can be seen by an examination of FIG. 5, rear, upper bar 16 is connected to seat stretcher member 17 by means of fastener 31A. Seat stretcher member 17 is then attached by fastener 31A to rear leg 12. Since the connection hole (not shown) at the end portion of each structural component is always symmetrically placed at about the centroidal axis of a given component, it can be seen that the junction of rear, upper cross-bar 16 and seat stretcher member 17 provides an orthogonal connection at joint 60 which places the outer face 17A of stretcher member 17 substantially flush with the side face 16B of rear, upper cross-bar 16. The orthogonal joint thus formed is both structurally sound and aesthetically pleasing. Additionally, the portion of the end face of cross-bar 16 preferably contacts and engages face-to-face the side surface of the rear leg 12.

The chair 5 of the present invention could be provided to the consumer in the form of a unassembled kit. Such a kit would greatly reduce the cost of the chair to the consumer with the individual consumer providing the labor necessary to assemble the chair into its final configuration. A kit form while used in many instances, lends itself especially to the present invention. This is a fact because the present invention provides component structural members which are highly unitized and easy to manufacture at a low cost. As has been more fully discussed, since each member is of a constant, square cross-sectional dimension and since constant diameter connecting holes and fasteners are utilized, a very minimal amount of manufacturing is in fact necessary. If a proper and well designed geometric assembly plan is provided to the individual, he can easily assemble the furniture article of the present invention in his spare time.

The following table provides a listing of parts which would be exemplary of a kit form which could be supplied to the consumer for assembly thereafter.

PARTS LIST

| DRAWING INDICATOR NO. | PART DESCRIPTION | QUANTITY |
|---|---|---|
| 12 | Rear legs (31" × 1 1/2" × 1 1/2") | 2 |
| 11 | Front legs (22 1/2" × 1 1/2" × 1 1/2") | 2 |
| 10 | Arm Rests (22 1/2" × 1 1/2" × 1 1/2") | 2 |
| 15 | Front Upper Cross-bar (22 1/2" × 1 1/2" × 1 1/2") | 1 |
| 17 | Stretcher bar (21 3/4" × 1 1/2" × 1 1/2") | 2 |
| 14 | Lower rear cross-bar (22" × 1 1/2" × 1 1/2") | 1 |
| 16 | Upper rear cross-bar (22" × 1 1/2" × 1 1/2") | 1 |
| 13 | Bottom Braces (22 1/2" × 1 1/2" × 1 1/2") | 2 |
| 31 | 1/4" diameter × 3" length threaded hex head/cap nut-head bolts | 18 |
| | 1/4" diameter × 7/16" shaft tee nuts with 3 knobs, each flange. | |
| | Split lock washers, 1/4". | |
| | Flat washer, 1/4". | |
| 20 | Sewn canvas back (14.75 oz. or greater weight/yard) | 1 |
| 25 | Sewn canvas seat (14.75 oz. or greater weight/yard) | 1 |

As exemplary materials for construction, all metal parts (which would be fasteners 31) could be chromed or brass plated. The woods could be high density hard wood, having a soaked natural oil finish.

For aesthetics, the structural members 10–17 could be provided with bevels on the edges and on the end portions. For example, a 1/16" bevil on all edges could be provided throughout the length of a structural component 10–17, and a 3/8" bevil on the end portions of each structural component could be provided. In order to economize the manufacture, all holes would be drilled at a constant diameter, preferably ¼" in order to correspondent with with a ¼" diameter as given in the exemplary table above for fasteners 31. The dimensions as given in the exemplary table would be dimensions for sanded wood finishes.

It is noted that joints 60 and joints 50 are typical examples of face-to-face joints which could be utilized to manufacture several different types of furniture using structural components of substantially identical, square cross-sections, the square cross-sectional members forming face-to-face and in some cases orthogonal joints as is shown in the figures. Thus, in addition to chairs, the present method of furniture manufacture could be used to produce other supporting furniture such as for example, sofas, ottomans, tables, desks, wall units, and the like. An entire line of furniture could be manufactured utilizing the same identical cross-sectional dimensioned components, the same diameter fasteners, and the same face-to-face joint technology as is taught by the present invention.

Because many varying and different embodiments may be taught within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed as invention is:

1. An article of supporting furniture, comprising:

a. two base side members and a cross member pivotally connected to each of said base side members to allow pivoting only in the horizontal plane;

b. two sides, each comprising:

1. a front leg member pivotally connected to and extending up from the front portions of one of said base side members, said front leg member being allowed to pivot only in the side plane defined by the base side member and the front leg member;

2. a rear leg member pivotally connected to and extending up from the rear portion of one of said base side members, said rear leg member being likewise allowed to pivot only in the side plane;

3. an arm rest member pivotally connected to the top portion of one of said front legs and an intermediate portion of the corresponding rear leg, said arm rest member being likewise allowed to pivot only in the corresponding side plane and defining with said base side member and said front and rear legs a four-sided polygon;

4. two side seat members pivotally connected to said front and rear leg members beneath said arm rest member, said side set members being likewise allowed to pivot in said side plane and dividing said four sided polygon into two smaller four-sided polygons, the structural rigidity of said side in said side plane deriving from the combined differences in pivotal radii with respect to said connections to said base side member of said front and rear leg members at the connections of said side seat member and said arm rest members;

c. a back seat member pivotally connected to said side seat members, said back member being allowed to pivot only in the seat plane defined by said two side seat members;

d. a front seat member pivotally connected to said side seat members, said front member being likewise allowed to pivot only in the seat plane; and e. flexible support material extending across any two opposite seat members to form a seat support surface.

2. The article of claim 1 further comprising flexible support material extending across the top portion of said rear legs to form a backing support surface.

3. The article of claim 1 wherein all of said members are elongated, substantially uniform, square cross-sectional members throughout their length, and the connections between said members are face-to-face, pinned connections.

4. The article of claim 3 wherein all of said members are connectable at their end portions through symmetrically drilled, equal diameter holes, said holes being drilled through the face portion of said members, said holes intersecting the longitudinal axis of said members at right angles, said holes being parallel to the two, non-drilled faces of said members, there being a plurality of equal diameter fasteners, said fasteners being insertable through said holes and capable of joining any two of said members at said holes.

5. The article of claim 1 wherein:

a. the angle which said front legs form with said base side members is of the order of 90°;

b. the angle which said rear legs form with said base side members is of the order of 100°;

c. the angle which said seat forms with said front leg members is of the order of 80°;

d. the angle which said seat forms with said rear leg members is of the order of 90°;

e. the angle which said arm rest members form with said front leg members of the order of 90°;

e. the angle which said arm rest members form with said front leg members of the order of 90°; and f. the angle which said arm rest members form with said rear leg members is of the order of 80°.

* * * * *